US010461429B2

(12) United States Patent
Durning et al.

(10) Patent No.: US 10,461,429 B2
(45) Date of Patent: Oct. 29, 2019

(54) SWITCHED ANTENNA ASSEMBLY

(71) Applicant: Apple Inc., Cupertino, CA (US)

(72) Inventors: Christopher J. Durning, Saratoga, CA (US); Hongfei Hu, Santa Clara, CA (US); Erdinc Irci, Sunnyvale, CA (US); Salih Yarga, Sunnyvale, CA (US); Christopher T. Cheng, Sunnyvale, CA (US); Enrique Ayala Vazquez, Watsonvile, CA (US); Nanbo Jin, San Jose, CA (US); Erica J. Tong, Pacifica, CA (US); Mattia Pascolini, San Francisco, CA (US); Denis J. Lin, Cupertino, CA (US); Salome Bavetta, Sunnyvale, CA (US); Sherry Lee, Oakland, CA (US)

(73) Assignee: Apple Inc., Cupertino, CA (US)

( * ) Notice: Subject to any disclaimer, the term of this patent is extended or adjusted under 35 U.S.C. 154(b) by 106 days.

(21) Appl. No.: 15/461,248

(22) Filed: Mar. 16, 2017

(65) Prior Publication Data

US 2018/0069308 A1 Mar. 8, 2018

Related U.S. Application Data

(60) Provisional application No. 62/384,109, filed on Sep. 6, 2016.

(51) Int. Cl.
*H01Q 1/24* (2006.01)
*H01Q 3/24* (2006.01)
(Continued)

(52) U.S. Cl.
CPC ..... *H01Q 9/0421* (2013.01); *H01Q 1/243* (2013.01); *H01Q 1/48* (2013.01); *H01Q 1/526* (2013.01); *H01Q 5/335* (2015.01)

(58) Field of Classification Search
CPC ..... H01Q 1/24; H01Q 1/243; H01Q 1/48; H01Q 1/38; H01Q 9/0421; H01Q 1/526; H01Q 3/24; H01Q 5/335
See application file for complete search history.

(56) References Cited

U.S. PATENT DOCUMENTS 4,311,972 A * 1/1982 Landt ..... H03H 7/40 333/17.3
4,313,121 A * 1/1982 Campbell ..... H01Q 9/36 343/790

(Continued)

FOREIGN PATENT DOCUMENTS

WO 2008/010149 A1 1/2008

*Primary Examiner* — Tho G Phan
(74) *Attorney, Agent, or Firm* — Dickinson Wright RLLP

(57) ABSTRACT

A consumer electronic product includes a switchable inductor array coupled to the RF antenna, the switchable inductor array comprising inductive elements and a switch circuit coupled to the inductor array to select at least one of the inductive elements and couple the selected inductive element with the RF antenna. The product can further include an assembly having a mesh that is strengthened by a stiffener. A multi-layer adhesive have a conductive layer that can be used to shield the RF antenna and adhesive layers that can provide adhesion between the stiffener and the housing of the product. The assembly can be covered by a cowling that is made of metal to provide further shielding. To reduce potential coupling between the RF antenna and the cowling, the cowling can have a portion that is formed of plastic to distance its metal portion from the antenna.

19 Claims, 7 Drawing Sheets

(51) Int. Cl.

| | |
|---|---|
| ***H01Q 9/04*** | (2006.01) |
| ***H01Q 1/48*** | (2006.01) |
| ***H01Q 1/52*** | (2006.01) |
| ***H01Q 5/335*** | (2015.01) |

(56) References Cited

U.S. PATENT DOCUMENTS

| | | | | |
|---|---|---|---|---|
| 8,339,372 | B2 | 12/2012 | Rofougaran | |
| 9,070,969 | B2 | 6/2015 | Mow et al. | |
| 9,071,336 | B2 | 6/2015 | Schlub et al. | |
| 9,166,279 | B2 | 10/2015 | Jin et al. | |
| 9,331,397 | B2 | 5/2016 | Jin et al. | |
| 9,531,061 | B2 * | 12/2016 | Han | H01Q 1/243 |
| 9,548,716 | B2 | 1/2017 | Manssen et al. | |
| 9,654,164 | B2 * | 5/2017 | Irci | H04B 1/3888 |
| 9,859,606 | B2 * | 1/2018 | Lee | H01Q 1/243 |
| 9,876,272 | B2 | 1/2018 | Hu et al. | |
| 10,084,236 | B2 * | 9/2018 | Meng | H01Q 1/243 |
| 10,199,718 | B2 | 2/2019 | Khalifa et al. | |
| 2012/0154247 | A1 * | 6/2012 | Braun | H01Q 9/40 343/876 |
| 2015/0207536 | A1 | 7/2015 | Yehezkely et al. | |
| 2016/0126618 | A1 | 5/2016 | Strange | |

* cited by examiner

SWITCHED ANTENNA ASSEMBLY

CROSS-REFERENCE TO RELATED APPLICATION

This application claims the benefit of U.S. Provisional Application No. 62/384,109, filed Sep. 6, 2016, entitled "SWITCHED ANTENNA ASSEMBLY", which is incorporated by reference herein in its entirety.

FIELD

The following description relates to electronic devices. In particular, the following description relates to radio frequency (RF) antennae. In particular, using connector assemblies having adjustable electrical characteristics to tune or otherwise modify RF antenna performance is described.

BACKGROUND

Portable electronic devices are designed to provide various functions. For example, a portable electronic device can establish wireless communication over various frequency bands that can require different RF antenna configurations for optimal performance.

SUMMARY

In one aspect, a consumer electronic product can include a housing assembly having walls that define an internal volume. A portion of a wall can be a radio frequency (RF) antenna. The consumer electronic product can also include a connector that is electrically coupled to the RF antenna. The connector has a fixed length. The consumer electronic product can further include a switchable inductor array that is electrically coupled to the RF antenna via the connector. The switchable inductor array can include inductive elements that cooperate with the connector to define an inductance of the connector. The consumer electronic product can further include a switch circuit coupled to the inductor array. The switch circuit is arranged to select at least one of the inductive elements to vary the inductance of the connector. In this way, the inductance of the connector, which can be act as the return path of the RF antenna, can be toned and the optimal frequency of the RF antenna can also be tuned without changing the length of the connector or return path.

In another aspect, an assembly carried by an enclosure of a portable electronic device is described. The enclosure of the portable electronic device can include an opening. The assembly can include a mesh fits to the opening such that a side of the mesh is exposed. The assembly can also include a stiffener carried by the enclosure. The stiffener can provide structural support to the receiver and electrically coupling the receiver to a ground to prevent users from receiving accidental electrical shocks. However, the stiffener may interfere with an RF antenna nearby. Hence, the assembly can further include a shield assembly positioned between the stiffener and the enclosure. The shield assembly can include a conductive layer positioned between adhesive layers so that the shield assembly adheres the stiffener to the enclosure and provides shielding to the RF antenna.

In yet another aspect, a method for tuning a radio frequency (RF) antenna that is coupled to a fixed length short pin is described. The method can include the steps of identifying a RF band for operation and identifying an RF antenna characteristic corresponding to the identified RF band. The method can also include determining a target inductance of the fixed length short pin that resonates with the RF antenna characteristic. The method can further include transitioning a state of a switch that is coupled to the fixed length short pin to change an inductance of the fixed length short pin to the target inductance.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
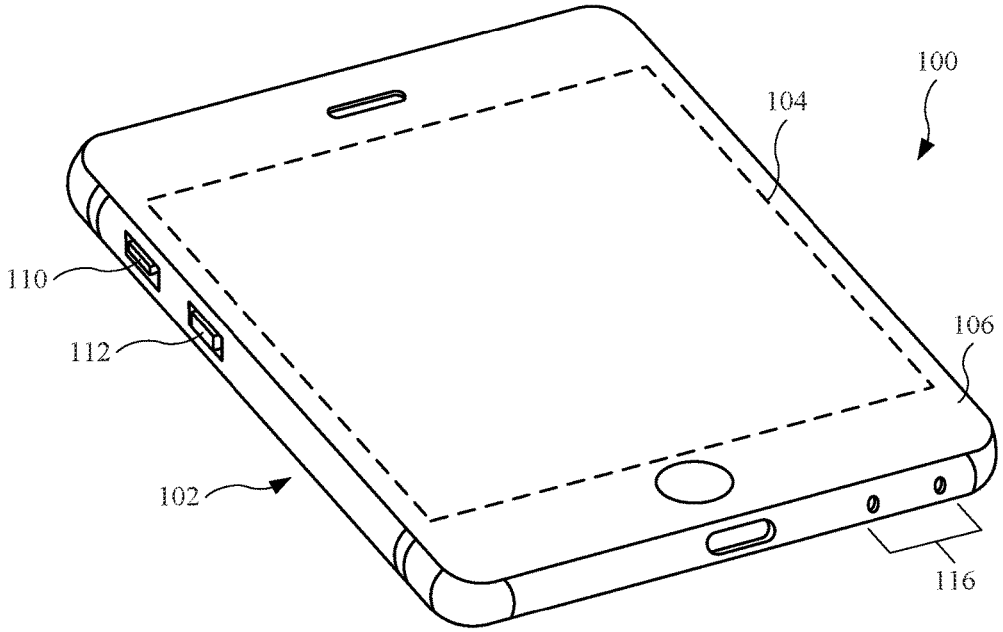
FIG. 1 illustrates a front isometric view of an embodiment of an electronic device, in accordance with some described embodiments.

Those skilled in the art will appreciate and understand that, according to common practice, various features of the drawings discussed below are not necessarily drawn to scale, and that dimensions of various features and elements of the drawings can be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments can be used, and changes can be made without departing from the spirit and scope of the described embodiments.

Many modern wireless communication devices include one or more sets of wireless circuitry, which can also be referred to as radios and/or wireless subsystems herein. The multiple radios can be used by a wireless communication device to communicate independently and/or concurrently via multiple wireless communication technologies. The wireless communication technologies can use different radio frequency bands having different bandwidths and can accommodate signals at different receive signal strength levels. The wireless communication device can also include a variety of hardware circuitry to provide additional processing functions that enhance the user's experience of the wireless communication device. Modern wireless communication devices can be used for voice, video, text, data, media generation and consumption, Internet browsing, gaming, etc. In some instances, one or more different sets of hardware circuitry in the wireless communication device can generate radio frequency energy that can leak into a radio frequency band used by one or more receivers of the wireless circuitry. This energy leakage can raise the noise/interference floor and can cause a problem known as "de-sense." In many instances, de-sense can negatively impact the use of certain radio frequency bands and, in severe cases, can render certain radio frequency bands unusable. Accordingly, interference that can result in de-sense poses a problem for concurrent operation of wireless circuitry configured to receive low level radio frequency signals and hardware circuitry that generates radio frequency interference that overlaps with the receive radio frequency bands used by the wireless circuitry.

Wireless circuitry of the wireless communication device can include transmitters and receivers that provide signal processing of radio frequency wireless signals formatted according to wireless communication protocols, e.g., according to a Wi-Fi wireless communication protocol, a Bluetooth wireless communication protocol, or a cellular wireless communication protocol. In some embodiments, the wireless circuitry can include components such as: processors and/or specific-purpose digital signal processing (DSP) circuitry for implementing functionality such as, but not limited to, baseband signal processing, physical layer processing, data link layer processing, and/or other functionality; one or more digital to analog converters (DACs) for converting digital data to analog signals; one or more analog to digital converters (ADCs) for converting analog signals to digital data; radio frequency (RF) circuitry (e.g., one or more amplifiers, mixers, filters, phase lock loops (PLLs), and/or oscillators); and/or other components. The wireless circuitry can be referred to herein as a radio and can include one or more components as described hereinabove. In some embodiments, the wireless circuitry can include a processor to determine settings for and/or configure operations of the wireless circuitry. The processor of the wireless circuitry, in some embodiments, can also communicate with other processors in the wireless communication device, e.g., a control processor, a host processor, an application processor, and/or a processor in the hardware circuitry.

In accordance with various implementations, any one of these consumer electronic devices can relate to: a cellular phone or a smart phone, a tablet computer, a laptop computer, a notebook computer, a personal computer, a netbook computer, a media player device, an electronic book device, a MiFi® device, a wearable computing device, as well as any other type of electronic computing device having wireless communication capability that can include communication via one or more wireless communication protocols such as used for communication on: a wireless wide area network (WWAN), a wireless metro area network (WMAN) a wireless local area network (WLAN), a wireless personal area network (WPAN), a near field communication (NFC), a cellular wireless network, a fourth generation (4G) Long Term Evolution (LTE) network, an LTE Advanced (LTE-A) wireless network, and/or a 5G or other present or future developed advanced cellular wireless network.

As consumer electronic devices become smaller and more compact, performance of wireless circuitry can be affected. More specifically, with the advent of multi-band wireless technology (MIMO, for example), the number and placement of antennae in the consumer electronic product are crucial to the overall wireless performance and user experience. In particular, a particular RF antenna can be used to transmit/receive wireless signals over different frequency bands. For example, the consumer electronic product can provide wireless communications in a number of frequency bands that can include, for example, low mid-band (LMB) that can extend from 1400 MHz to 1710 MHz, mid-band (MB) that can extend from about 1710 MHz to about 2170 and high-band (HB) that can extend from about 2300 MHz to about 2700 MHz. Accordingly, in order to improve RF antenna performance, each RF antenna can be tuned so as to provide optimal performance in a particular frequency band. As described in U.S. patent application entitled, Electronic Device Antenna With Switchable Return Paths by Vazquez et. al. filed Jul. 28, 2015 and having U.S. patent application Ser. No. 14/811,714 that is incorporated by reference in its entirety for all purposes, an RF antenna can be coupled to ground by way of a electronic component having electrical characteristics that can be adjusted in such a way so as to optimize the performance of the RF antenna while operating in a particular frequency band. For example, in one embodiment, the electronic component can take the form of an inductive element (or inductor equivalent) characterized as having an adjustable inductance value. The inductance value can be altered in accordance with a wireless operation performed by the consumer electronic product. In one state, the inductance value can be null as the inductive elements can be electrically disconnected from the RF antenna. In another state, the inductance value can be characterized as a combination of inductance values of individual inductors selectively coupled together using a switching element controlled by a processor, for example. In this way, the RF antenna can be tuned in such a way as to provide optimal performance for a selected frequency band.

It should be noted that, in addition to using discrete electrical components, performance of an active RF antenna can be optimized using a parasitic antenna resonating element, also referred to as a High Band Arm (HBA). In one embodiment, the HBA can be embedded within a non-conductive medium (such as a plastic filler) in the vicinity of a main RF antenna. The parasitic antenna resonating element (or more simply, the parasitic element) can be grounded to a chassis ground (provided by, for example, metal portions of a housing assembly) and is embedded within the plastic filler. It should be noted that the purpose of the parasitic element is to modify the radiation pattern of the radio waves emitted by the RF antenna by acting as a passive resonator (i.e., absorbing the RF energy from a nearby driven RF antenna and re-radiating the RF energy with a different phase). In this way, the RF energy from different RF antenna elements can interfere to strengthen the antenna's radiation in the desired direction, and cancelling out the waves in undesired directions. For example, the passive element can be used to direct RF energy from the RF antenna in a beam in one direction thereby increasing the antenna's gain.

In one embodiment, the HBA can be have electrical characteristics that can be modified, or tuned, so as to optimize the overall performance of the nearby main RF antenna in a particular frequency band. For example, the HBA can take the form of a flexible connector (or flex) having electrically conductive traces embedded in a flexible dielectric material. The HBA flex can, in turn, be electrically coupled to a ground plane as well as electrical components (such as a capacitor) that can be used to alter a capacitance value of the HBA flex. By changing the capacitance value of the HBA flex, the overall interaction between the HBA flex and the RF antenna can also be altered in such a way as to optimize the performance characteristics of the RF antenna. In one embodiment, the electrical component connected to the flex can take the form of a switchable inductive element by which it is meant that an inductor (or inductors) can be switchable coupled to the flex in any suitable combination thereby providing the ability to alter performance characteristics of the RF antenna on the fly, so to speak.

It should be noted, that metal or metallic objects can have a deleterious effect on the overall performance of an RF antenna. For example, an electrically conductive non-metallic object can mimic a lossy metallic object in that the interaction with a near-by RF antenna can cause loss of gain and overall performance. Therefore, in those situations where such an electrically conductive non-metallic object is present, it can be advantageous to provide a metal interface that can act as a shield to prevent substantial interaction between the RF antenna and the electrically conductive non-metallic object. In one embodiment, the electrically conductive non-metallic object can take the form of a dielectric material (such as plastic) having conductive particles embedded therein. Although the embedded conductive particles imbue the non-metallic object with sufficient conductivity to provide a path to ground, for example, the non-metallic object can interfere with the operation of the RF antenna, thus resulting in a reduced overall performance. In one embodiment, a conductive substrate that can be formed of a layer of a conductive metal (such as copper) can be used to shield, or otherwise, isolate the non-metallic conductive object from the RF antenna. In one embodiment, the conductive metal can take the form of a contiguous layer whereas in another embodiment, the conductive metal can take the form of segments of metal. In any case, the metal can be disposed between layers of adhesive. In this way, the metal (in whichever form is deemed appropriate) can be used as an RF shield that can be placed in any desired location.

Accordingly, this paper describes a number of embodiments related to structural elements and housing designs that can be used to provide optimal RF characteristics. The structural elements can include, for example, a connector assembly that can couple an RF antenna to ground or main logic board (MLB) having at least a processor. The connector assembly can act as an RF antenna return path and can include an electrical component having adjustable electrical characteristics coupled to a connector used to electrically connect the RF antenna to a ground plane or an electrical circuit. The electrical circuit can include processing resources used to alter the electrical characteristics of the electrical component. For example, the connector assembly can include a switch (or switches) that can be controlled by the processing resources. The switch can be used to connect one or more discrete electrical components (such as inductors) to the RF antenna in such as way so as to alter the RF performance accordingly. Other structural elements can include a shroud or cowling that can act as an RF shield suitable for isolating an RF antenna from conductive objects that would other degrade the performance of the RF antenna.

These and other embodiments are discussed below with reference to FIGS. 1-8. However, those skilled in the art will readily appreciate that the detailed description given herein with respect to these Figures is for explanatory purposes only and should not be construed as limiting.

FIG. 1 illustrates a front isometric view of an electronic device 100, in accordance with some described embodiments. In some embodiments, the electronic device 100 is a laptop computer device. In other embodiments, the electronic device 100 is a wearable electronic device designed to secure with an appendage of a user of the electronic device 100. In the embodiment shown in FIG. 1, the electronic device 100 is a consumer electronic device, such as a mobile wireless communication device that takes the form of, for example, a smartphone or a tablet computer device.

The electronic device 100 can include an enclosure 102 having several sidewalls and a rear wall that combine to define an internal cavity that receives several internal components (not shown), such as a processor circuit, a memory circuit, an internal power, and speaker module, as non-limiting examples. The enclosure 102 can be formed from a metal, such as aluminum or an alloy that includes aluminum. However, other materials are possible, such as a rigid plastic or ceramic. Also, when the enclosure 102 is formed from a metal that is anodizable, the enclosure 102 can undergo an anodization process that immersing the enclosure 102 in an anodic bath with one or more acidic compounds. The anodization process is designed to provide an aesthetic finish to the enclosure 102 as well as improve the structural rigidity.

The electronic device 100 can further include a display assembly 104 (shown as a dotted line) designed to present visual information, such as video or still images, to a user of the electronic device 100. The electronic device 100 can further include a protective layer 106 that covers the display assembly 104. The protective layer 106 can include a transparent material, such as glass or sapphire. Further, the display assembly 104 can include a touch-sensitive layer, including capacitive touch-sensitive technology, designed to respond to a touch input to the display assembly 104 (through the protective layer 106). The display assembly 104 can respond to the touch input by changing the visual information presented on the display assembly 104. Although not shown, the electronic device 100 can include a frame that carries the protective layer 106. The frame is designed to couple or mate with the enclosure 102.

The electronic device 100 can include external controls that provide an input or command to an internal component of the electronic device 100. For example, the electronic device 100 can include a switch 110 electrically coupled to a processor circuit in the electronic device 100. The switch 110 can be actuated relative to the enclosure 102 in a direction toward or away from the protective layer 106. The electronic device 100 can further include a button 112 electrically coupled to a processor circuit in the electronic device 100. The button 112 can be actuated relative to the enclosure 102 in a direction toward the enclosure 102.

The electronic device 100 can further require additional openings for associated features of the electronic device 100. For example, the electronic device 100 can include openings 116, or through holes, formed in the enclosure 102. The openings 116 can allow acoustical energy, generated by a speaker module (not shown), to exit the electronic device 100. While a discrete number of openings are shown, additional openings are possible. Moreover, some additional openings can allow airflow into and out of the electronic device 100, thereby providing an air vent for the electronic device 100.

Figure 2:
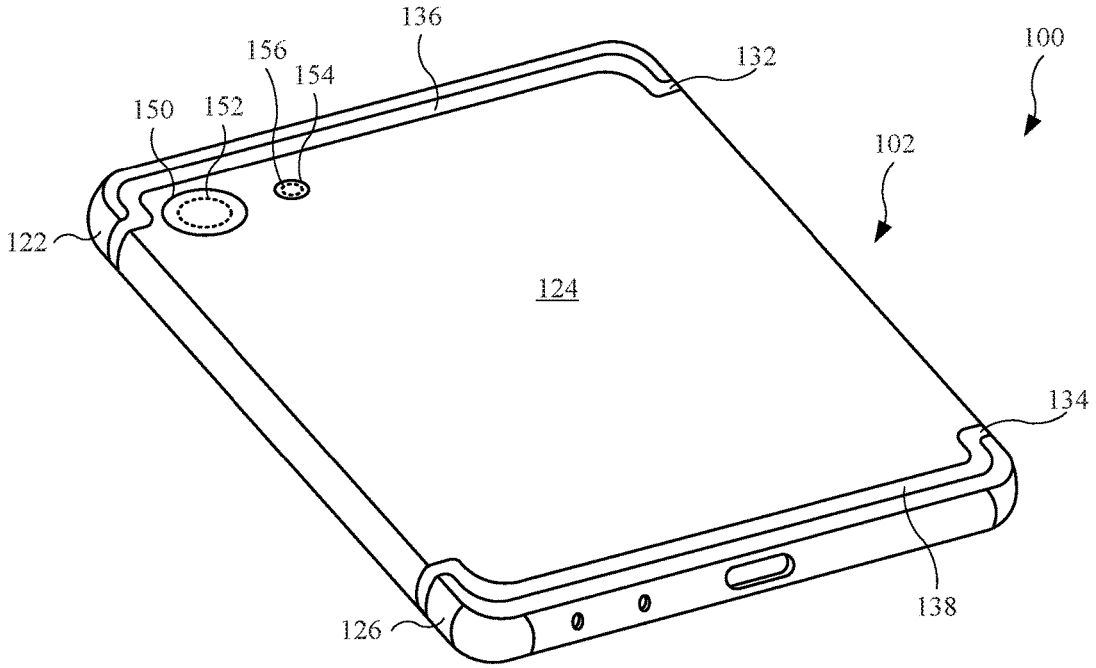
FIG. 2 illustrates a rear isometric view of the electronic device shown in FIG. 1, showing various features of the enclosure.

FIG. 2 illustrates a rear isometric view of the electronic device 100 shown in FIG. 1. As shown, the enclosure 102 can be partitioned into multiple regions. For example, the enclosure 102 can include a first housing part 122 and a second housing part 124 separated by a first channel 132. The enclosure 102 can further include a third housing part 126 separated from the second housing part 124 by a second channel 134. It should be noted that first housing part 122 and third housing part 126 (or part of first housing part 122 and part of third housing part 126) can be operable as upper RF antenna 122 and lower RF antenna 126, respectively. A cutting operation (not shown), including CNC or milling, as non-limiting examples, applied to the enclosure 102 can form the first channel 132. Accordingly, the first channel 132 and the second channel 134 define regions of the electronic device 100 void of metal. This can allow an antenna (not shown) to transmit radio frequency ("RF") communication through the first channel 132 or the second channel 134, depending upon the location of the antenna in the electronic device 100. However, the aforementioned housing parts can be interconnected or interlocked together. This will be shown and described below.

The first channel 132 and the second channel 134 can be filled with a material (or materials). For example, the first channel 132 includes a material 136 designed to cover a second material (not shown) and provide an aesthetic finish to the electronic device 100. In some embodiments, the material 136 can include a polymeric material, such as plastic. The material 136 can include a moldable material applied, in liquid form, to the first channel 132 by a molding operation and then cured to solidify. Also, the material 136 can be co-planar, or approximately, co-planar with respect to the first housing part 122 and the second housing part 124. The second channel 134 can also include a material 138 that can include any feature described for the material 136 in the first channel 132.

The first housing part 122 and the third housing part 126 can provide a rigid cover to protect some components of the electronic device 100. However, in some instances, each of the first housing part 122 and the third housing part 126 can form part of an antenna used to enable wireless communication. The second housing part 124, also referred to as a chassis, can provide not only a rigid, protective cover, but also an electrical ground for internal components of the electronic device electrically coupled with the second housing part 124.

Also, the enclosure 102, and in particular, the second housing part 124, can include a first opening 150 used by a camera module 152 of the electronic device 100. Also, the second housing part 124 can include a second opening 154 used by a camera flash 156 of the electronic device 100 to enhance the image capture capabilities of the camera module 152.

Figure 3A:
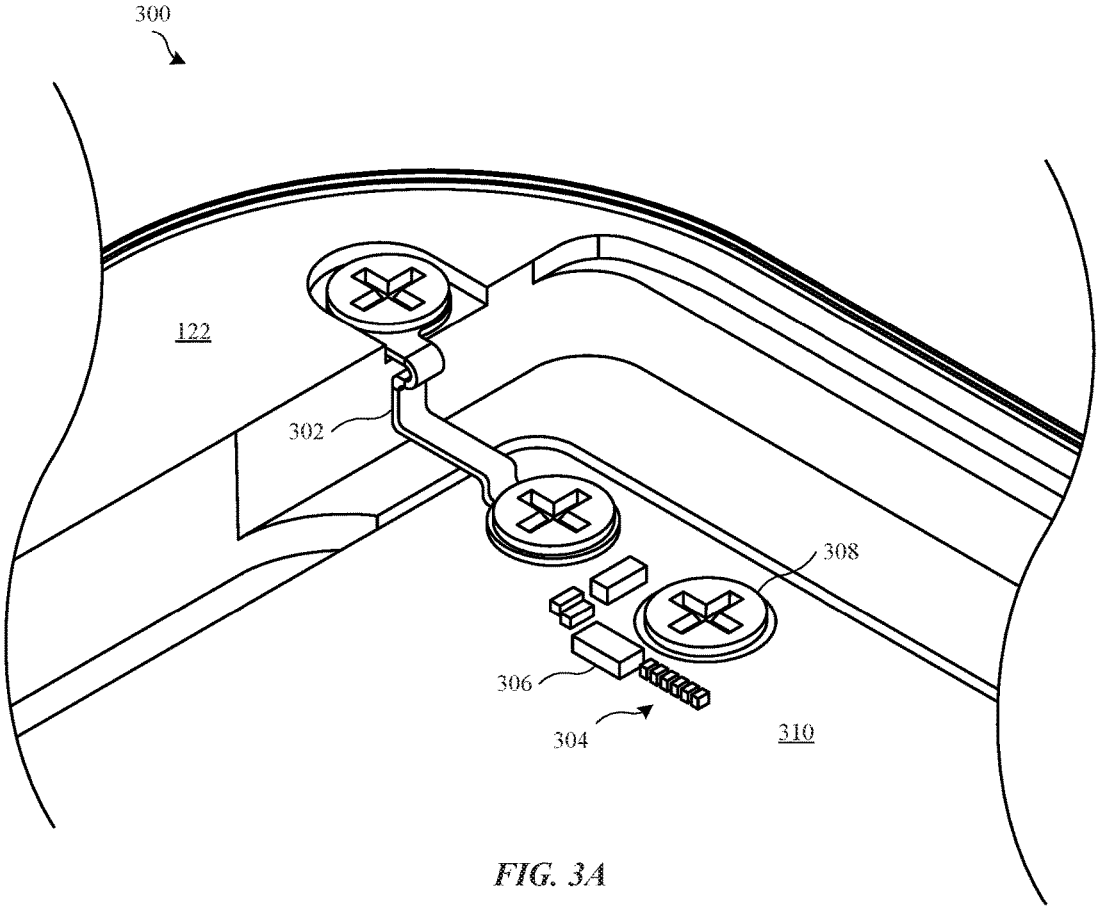
FIG. 3A illustrates an embodiment of a connector assembly that provides a return path having variable properties used to tune an RF antenna.
Figure 3B:
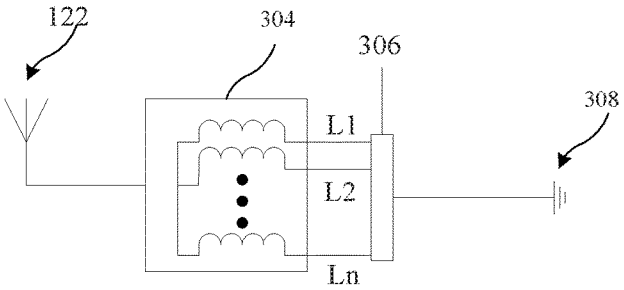
FIG. 3B is a schematic diagram illustrating a possible circuit arrangement of the embodiment shown in FIG. 3A.

FIG. 3A shows a plan view 300 of electronic device 100 and more particularly upper RF antenna 122. RF antenna 122 is coupled by way of connector 302 to inductor array 304. Connector 302 can also be referred as a short pin. Connector 302 can have a fixed length. Inductor array 304 can include any number of discrete inductive components such as inductors L1, L2, to Ln, each of which is associated with a particular inductance value. Inductor array 304 can be coupled to switch array 306 (that can be incorporated within a control board 310 such as a main logic board, or MLB) arranged to selectively couple individual inductors L of inductor array 304 to system ground 308, thus forming a return path for RF antenna 122 as shown schematically in FIG. 3B. Switch array 306 can be triggered by switch signal S that can be provided by control board 310 that can be used to combine any number of inductors L in inductor array 304. For example, in one state, switch signal S1 can cause inductor array 304 to provide inductance L1 corresponding to a first discrete inductor. In another state, switch signal S2 can cause inductor array 304 to provide inductance L2 that can correspond to a second discrete inductor, however, inductance L2 can also correspond to a combination of inductors. For example, switch signal S2 can cause first and second discrete inductors to be connected in parallel, or in series, depending upon the desired characteristics of RF antenna 122. It should be noted that in some cases, switching signal S can cause switch array 306 to de-couple all inductive elements within inductor array 304.

Figure 4A:
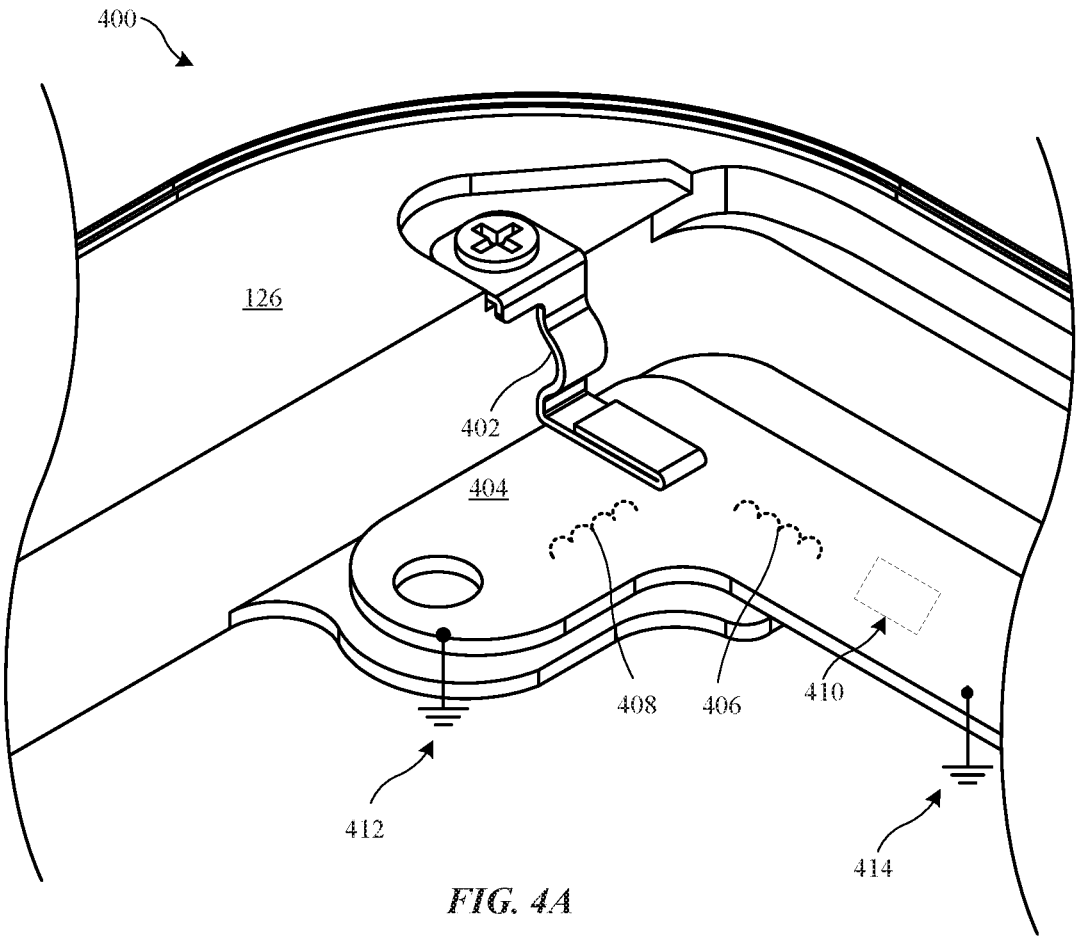
FIG. 4A illustrates another embodiment of a connector assembly that provides a return path having variable properties used to tune an RF antenna.
Figure 4B:
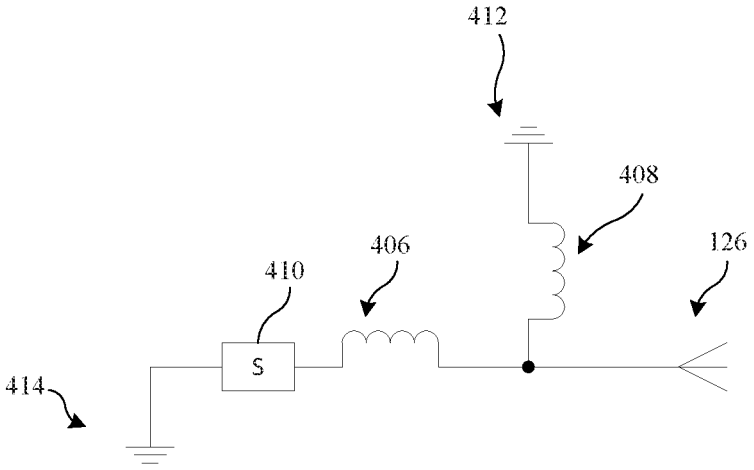
FIG. 4B is a schematic diagram illustrating a possible circuit arrangement of the embodiment shown in FIG. 4A.

FIG. 4A shows a plan view 400 of electronic device 100 and more particularly lower RF antenna 126. RF antenna 126 is coupled by way of connector 402 to flex 404 with traces (not shown) that provide inductance represented by inductors 406 and 408 connected in parallel to switch element 410 (represented by schematic diagram of FIG. 4B) to housing ground 414. Inductor 408 is also connected to housing ground 412. In this way, switch element 410 can de-couple inductance represented by inductor 406 to provide a return path for RF antenna 126 having only inductance represented by inductor 408. Switch element 410 can also couple inductance represented by inductor 406 to provide a return path for RF antenna 126 having an equivalent inductance represented by inductors 408 and 406 in parallel.

Figure 5A:
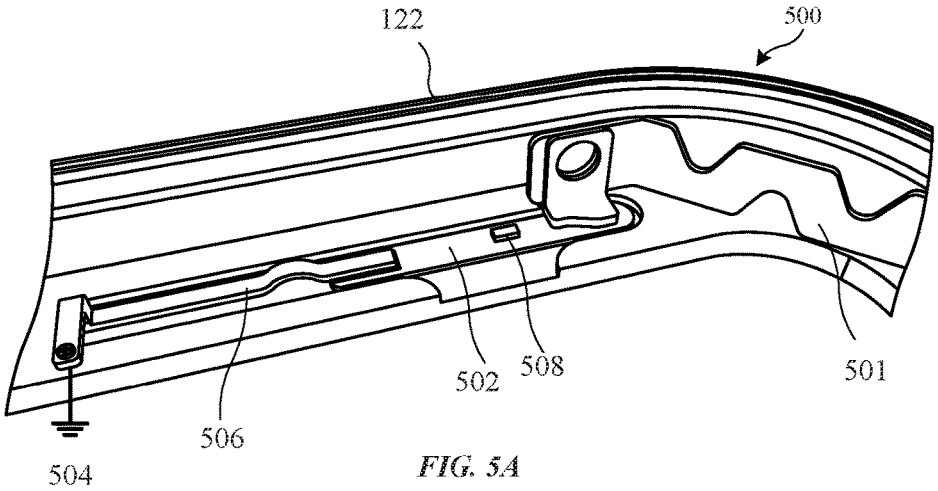
FIG. 5A illustrates an embodiment of a flex assembly having variable properties used to tune an RF antenna.
Figure 5B:
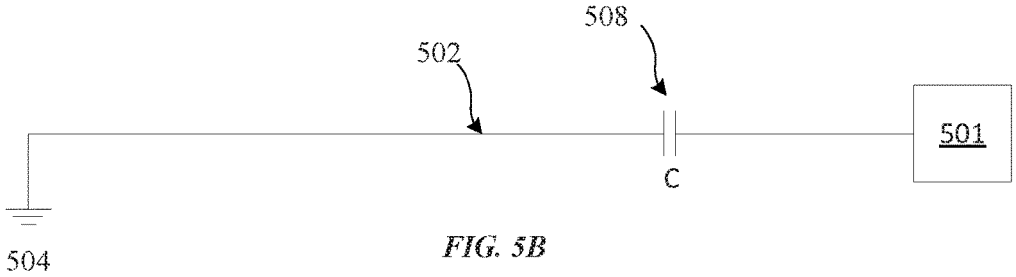
FIGS. 5B-5E are schematic diagrams illustrating different possible circuit arrangements of embodiments shown in FIG. 5A.
Figure 5C:
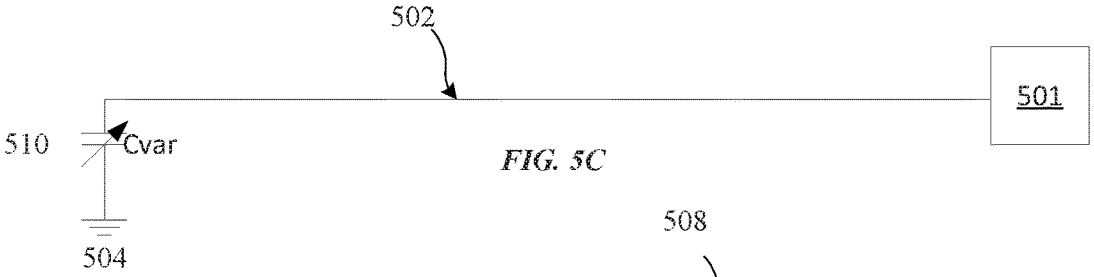
Figure 5D:
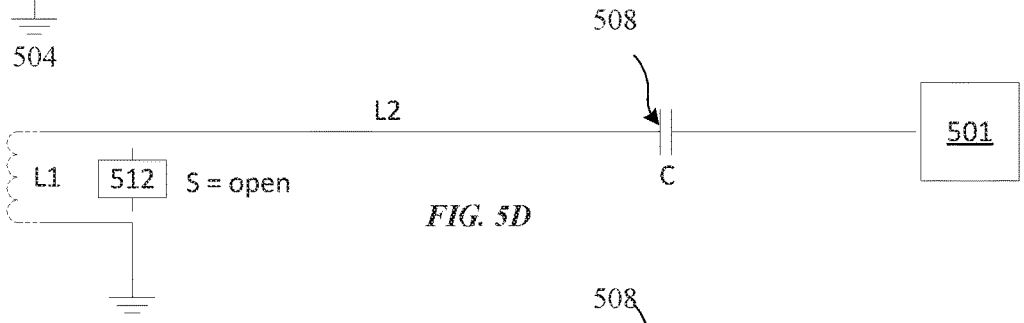

FIG. 5A shows a plan view 500 of electronic device 100 and more particularly upper RF antenna 122 with HBA flex 502 arranged to couple HBA to ground 504. The HBA can be an elongated structure that has an antenna end being electrically coupled to portion of RF antenna 501 and a grounded end that is electrically coupled to ground 504. The HBA can include the flex 502 and a metal arm 506 that is connected to ground 504. Ground 504 can be a chassis ground. HBA flex 502 can include capacitor 508 that can be used to tune the optimal RF characteristic of the HBA. In one case, as shown schematically in FIG. 5C, capacitor 508 can be a variable capacitor 510 that can be varied to change the coupling between the HBA and the ground, thus having the effect of enabling different HBA lengths. In another case, as shown schematically in FIG. 5D and FIG. 5E, switch 512 can be used to vary the inductance of HBA. For example, in one particular arrangement, switch 512 is connected in between ground 504 and capacitor 508, providing a path of short circuit when switch 512 is "on." Inductor L1 can also be connected with the switch 512 in parallel. When switch 510 is "off", inductance L1 is coupled to capacitor 508 as shown in FIG. 5D (corresponding to a "long" HBA flex) whereas when switch 510 is "on", then capacitor 508 is coupled to inductance L2 (corresponding to a "short" HBA flex) because now a shorted path is provided to bypass the inductor L1.

While the embodiments shown in FIGS. 3A and 5A are described as possible arrangements of upper RF antenna 122 and the embodiment shown in FIG. 4A is described as possible arrangement of lower RF antenna 126, it should be understood the embodiments described in this paper are not limited by the position of any RF antenna. For example, any antenna such as a lower RF antenna can also have the arrangements as shown in FIG. 3A and/or FIG. 5A.

Figure 6A:
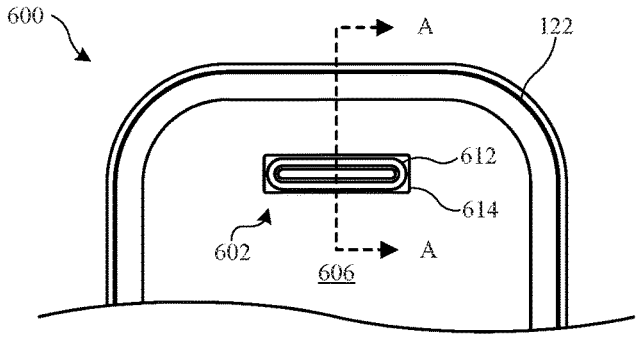
FIG. 6A shows an RF isolation shield in accordance with an embodiment.
Figure 6B:
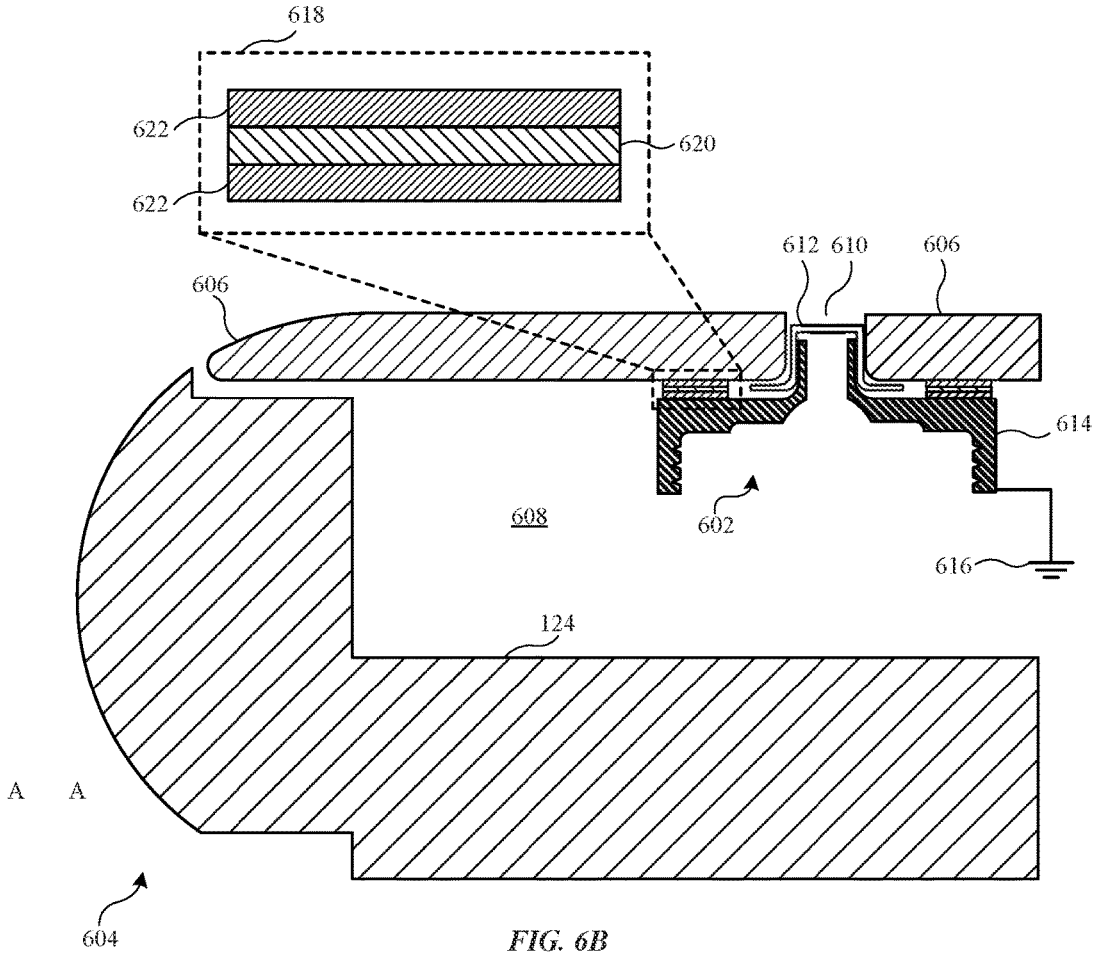
FIG. 6B shows a cross-section view of the RF isolation shield arrangement as shown in FIG. 6A.

FIGS. 6A and 6B show an assembly 602 carried by an enclosure 604 of electronic device 100 in the upper portion 600. Enclosure 604 can include metal housing part 124 and cover glass 606 that cooperate to form cavity 608 to receive internal components of electronic device 100. Cover glass 606 can have opening 610 that provides an outlet for sound of a speaker. Assembly 602 can be carried by the cover glass 606 to cover the opening 610. Assembly 602 can include mesh 612 that can be used to prevent ingress of contaminants. Mesh 612 can be at shaped to fit opening 610 and be located at least partially within opening 610 so that at least a side of mesh 612 is exposed. As shown in FIG. 6B, assembly 602 can also include stiffener 614 arranged to provide structural integrity to mesh 612. In some cases, stiffener 614 can be conductive and be coupled to ground 616 so that mesh 614 is grounded. In one case, stiffener 614 can be formed of a metal. However, in some situations metal is avoided for cosmetic reason because the metal can be visible by the users through cover glass 606. In other cases, stiffener 614 can be made of a plastic or carbon fiber that is molded with tiny pieces of metals to provide conductivity to the stiffener 614. In some cases, conductive stiffener 614 can be formed of a lossy material that degrades RF performance (such lossy material may include a carbon fiber filled resin). As metal portion of housing part 124 may partially form an RF antenna, assembly 602 can be positioned in the vicinity of upper RF antenna 122. In order to avoid interaction between stiffener 614 and RF antenna 122, RF shield assembly 618 can be used to isolate stiffener 614 from RF antenna 122. In this way, the performance of RF antenna 122 can be maintained. In one embodiment, (shown in FIG. 6B) assembly 602 can include RF seal assembly 618 having conductive layer 620. In one embodiment, conductive layer 620 can take the form of a sheet of metal such as copper. In one embodiment, conductive layer 620 can take the form of segments spaced apart to preserve the isolation between RF antenna 122 and stiffener 614. In one embodiment, conductive layer 620 can be positioned between adhesive layers 622. Adhesive layers 622 can provide adhesion between stiffener 614 and an enclosure such as cover glass 606.

Figure 7A:
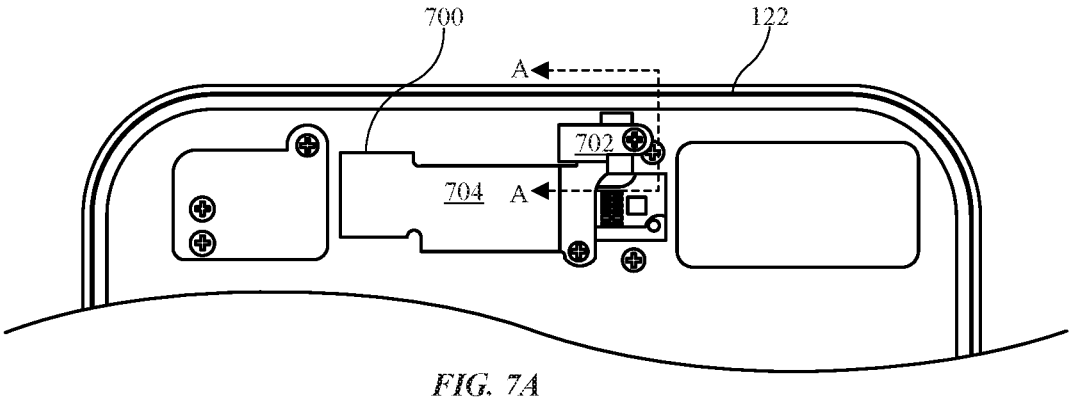
FIG. 7A shows a cowling suitable for use in proximity to an RF antenna in accordance with an embodiment.
Figure 7B:
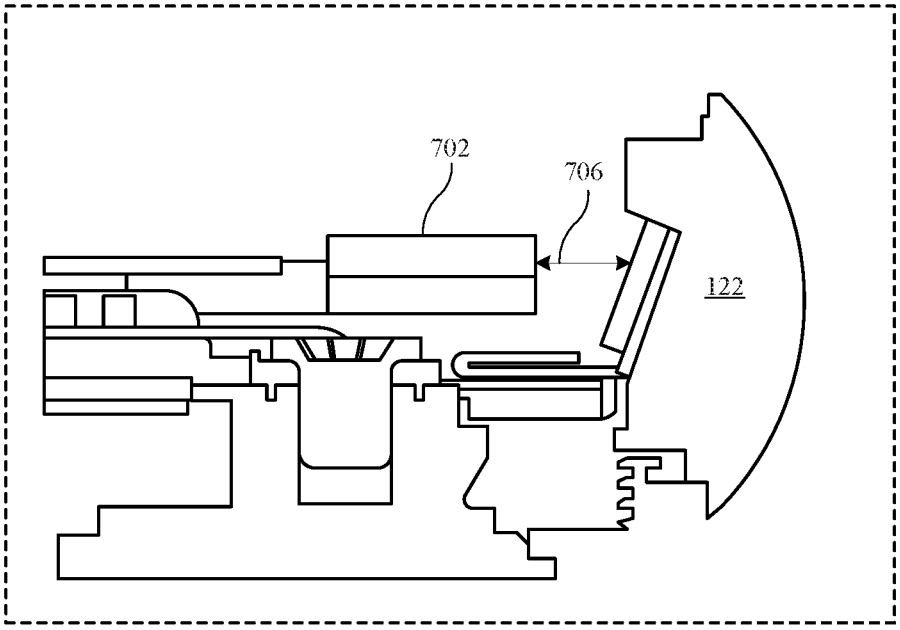
FIG. 7B shows a cross-section view of the cowling arrangement as shown in FIG. 7A.

FIGS. 7A and 7B show receiver cowling 700 in accordance with the described embodiments. Receiver cowling 700 can be used to cowl (or cover) assembly 602 and other components. Receiver cowling 700 can cooperate with the enclosure of electronic device 100 to cover assembly 602. It should be noted that since receiver cowling 700 is located in close proximity to upper RF antenna 122, and since it is part of the system ground plane, coupling between receiver cowling 700 and RF antenna 122 can occur. In order to reduce the coupling between receiver cowling 700 and RF antenna 122, portion 702 of receiver cowling 700 can be formed of plastic and be injection molded to portion 704 that is formed of metal. Hence, plastic portion 702 can be positioned between metal portion 704 and RF antenna 122. In this way, gap 706 between RF antenna 122 and metal portion 704 of receiver cowling 700 can be increased.

Figure 5E:
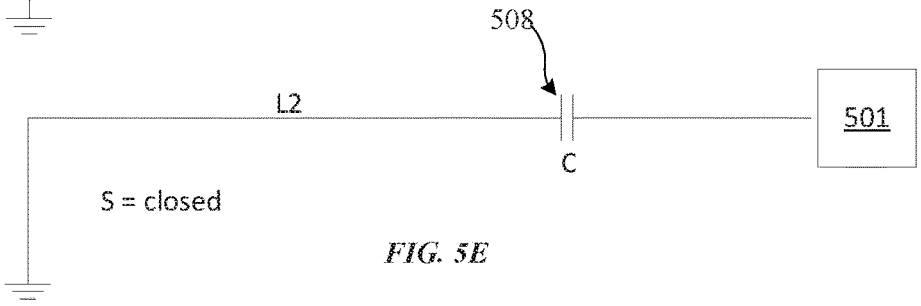
Figure 8:
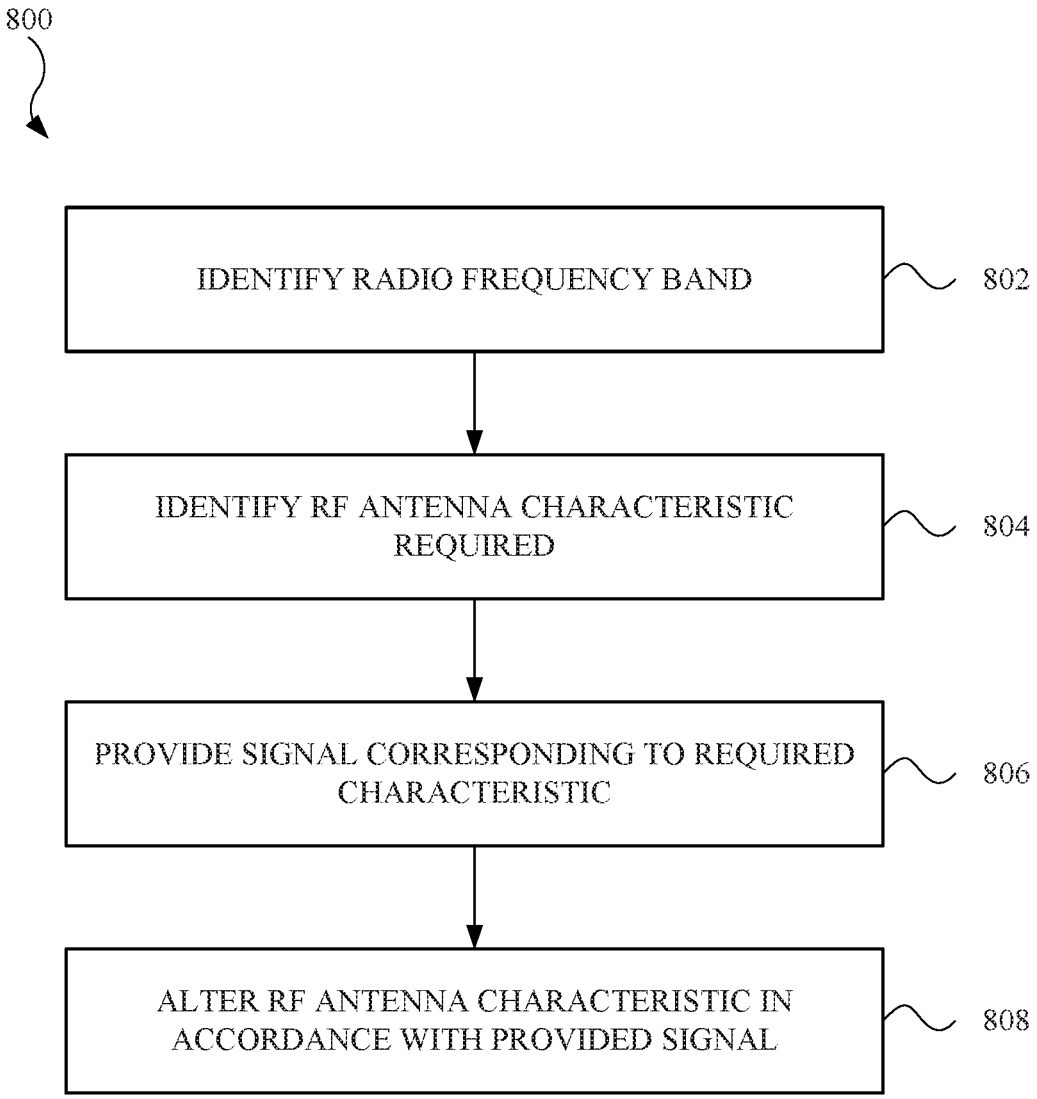
FIG. 8 shows a flowchart detailing a process in accordance with an embodiment.

FIG. 8 shows a flowchart describing process 800 in accordance with the described embodiments. Process 800 begins at 802 by identifying a radio frequency (RF) band for operation. The identification of an RF band can be based on a SIM card setting, an initiation of a RF protocol such as Wi-Fi or Bluetooth, a processor command based on a user input, a receipt or detection of a wireless network, and/or etc. At 804, an RF antenna characteristic corresponding to the identified RF band is identified. For example, a particular resonating frequency or wavelength of the RF band is identified. At 806, a signal is provided corresponding to the identified characteristic. At 808, the RF antenna characteristic is altered in accordance with the provided signal. Specifically, a processor, such as a central processor on the MLB or a baseband processor, can determine a target inductance that allows a fixed length short pin to resonate with the identified RF antenna characteristic. In turn, the processor can cause a switch to transition so that the inductance of the short pin is changed to the target inductance. For example, a process on the MLB can cause switch array 306 as shown in FIG. 3A to select one or more inductors in inductor array 304 to alter the inductance of connector 302 in response to a change of RF band request due to a switching of Wi-Fi network. Likewise, a processor can cause switch 410 as shown in FIG. 4A to turn on or off to include or exclude inductor 406 in order to change inductance of connector 402 associated with lower RF antenna 126. Also, a baseband processor can adjust the RF antenna characteristic of the HBA 502 based on a SIM card by causing switch 512 to close to bypass L1 as shown in FIGS. 5D and 5E to reduce inductance of HBA 502 in response to a change in wireless network.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data that can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A consumer electronic product, comprising:

a housing having walls that define an internal volume, wherein a portion of one of the walls is a radio frequency (RF) antenna;

a connector electrically coupled to the RF antenna, the connector having a fixed length;

a switchable inductor array electrically coupled to the RF antenna via the connector, the switchable inductor array comprising inductive elements that cooperate with the connector to define an inductance of the connector; and a switch circuit coupled to the switchable inductor array and arranged to select at least one of the inductive elements to vary the inductance of the connector.

2. The consumer electronic product as recited in claim 1, wherein the switchable inductor array and the switch circuit are carried by a mother logic board.

3. The consumer electronic product as recited in claim 1, wherein the switchable inductor array and the switch circuit are carried by a flexible circuit.

4. The consumer electronic product as recited in claim 1, wherein the switchable inductor array comprises multiple inductors connected in parallel.

5. The consumer electronic product as recited in claim 1, wherein the RF antenna is further coupled to a band arm, the band arm comprising:

an antenna end electrically coupled to the RF antenna;

a grounded end electrically coupled to the housing such that the grounded end is grounded by the housing; and a capacitor electrically coupled between the antenna end and the grounded end.

6. The consumer electronic product as recited in claim 5, wherein the band arm further comprises:

an inductor electrically coupled between the grounded end and the capacitor; and a switch electrically coupled between the grounded end and the capacitor, the switch being in parallel with the inductor and adapted to selectively provide a shorted path that bypasses the inductor.

7. The consumer electronic product as recited in claim 5, wherein the capacitor is a variable capacitor.

8. A method for tuning a radio frequency (RF) antenna coupled to a fixed length connector, comprising:

identifying a RF band for operation;

identifying an RF antenna characteristic corresponding to the identified RF band;

determining a target inductance of the fixed length connector that resonates with the RF antenna characteristic; and transitioning a state of a switch that is coupled to the fixed length connector to change an inductance of the fixed length connector to the target inductance.

9. The method as recited in claim 8, wherein the transitioning of the state of the switch comprises selecting multiple inductors connected in parallel.

10. The method as recited in claim 8, wherein the fixed length connector is coupled to two inductors in parallel and transitioning the state of the switch comprises opening or closing a circuit associated with one of the two inductors.

11. The method as recited in claim 8, wherein the transitioning of the state of the switch comprises shorting a circuit to bypass an inductor.

12. A consumer electronic product, comprising:

a housing having walls that define an internal cavity, wherein the walls are capable of carrying operational components within the internal cavity that include:

a radio frequency (RF) antenna, a connector electrically couple to the RF antenna, a switchable inductor array electrically coupled to the RF antenna via the connector, wherein the switchable inductor array includes inductive elements that cooperate with the connector to define and inductance value, and a switch array that is electrically coupled to the switchable inductor array, wherein the switch array is capable of altering the inductance value.

13. The consumer electronic product of claim 12, wherein the connector has a fixed length.

14. The consumer electronic product of claim 12, wherein the switch array is capable of transitioning between a first state and a second state different than the first state.

15. The consumer electronic product of claim 12, wherein the switchable inductor array and the switch array are carried by flexible circuit.

16. The consumer electronic product of claim 12, wherein the target inductance value is associated with the connector resonating at a predetermined RF antenna characteristic.

17. The consumer electronic product of claim 16, wherein the operational components further include a processor capable of identifying a RF band corresponding to the predetermined RF antenna characteristic.

18. The consumer electronic product of claim 12, wherein the switch array is capable of tuning the RF antenna without altering a length of the connector.

19. The consumer electronic product of claim 12, wherein the RF antenna is coupled to a parasitic resonating element.

* * * * *